US009397452B1

(12) United States Patent
Fan et al.

(10) Patent No.: US 9,397,452 B1
(45) Date of Patent: Jul. 19, 2016

(54) CONNECTING DEVICE WITH JUMPER

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Yong-Chang Fan, Wuhan (CN); San-Yong Yang, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/685,269

(22) Filed: Apr. 13, 2015

(30) Foreign Application Priority Data

Feb. 10, 2015 (CN) ..... 2015 1 0067806

(51) Int. Cl.
*H01R 31/08* (2006.01)
*H01R 24/28* (2011.01)
*H01R 103/00* (2006.01)

(52) U.S. Cl.
CPC ..... *H01R 24/28* (2013.01); *H01R 31/08* (2013.01); *H01R 2103/00* (2013.01)

(58) Field of Classification Search
USPC ..... 439/507, 510–513
See application file for complete search history.

(56) References Cited

U.S. PATENT DOCUMENTS 3,601,754 A * 8/1971 Filson ..... H01R 31/00 439/507
4,602,834 A * 7/1986 Hahn ..... H01R 31/08 439/510
5,556,301 A * 9/1996 Chishima ..... H01R 31/08 439/101
8,616,915 B2 * 12/2013 Funamura ..... H01R 31/08 439/507

* cited by examiner

*Primary Examiner* — Tho D Ta
(74) *Attorney, Agent, or Firm* — ScienBiziP, P.C.

(57) ABSTRACT

A connecting device includes a connector and a jumper. The connector includes an enclosure and two terminals mounted in the enclosure. The two terminals are spaced apart. Each terminal includes a contact defining a latching hole. The jumper includes a case and a conductor received in the case. The conductor includes two contacting arms. Each contacting arm includes a latching portion. Each contact extends into the case, each latching portion is engaged in one of the two latching holes to mount the jumper to the connector, and the two terminals are electronically coupled to each other.

19 Claims, 5 Drawing Sheets

CONNECTING DEVICE WITH JUMPER

CROSS-REFERENCE TO RELATED APPLICATIONS

This application claims priority to Chinese Patent Application No. 201410021618.6 filed on Jan. 17, 2014 in the China Intellectual Property Office, the contents of which are incorporated by reference herein.

FIELD

The subject matter herein generally relates to connecting devices, and more particularly to a connecting device for a power supply.

BACKGROUND

A connector includes a plurality of terminals with different functions. When users need special functions, the terminals with the special functions should be connected together.

BRIEF DESCRIPTION OF THE DRAWINGS

Implementations of the present technology will now be described, by way of example only, with reference to the attached figures.

DETAILED DESCRIPTION

Figure 1:
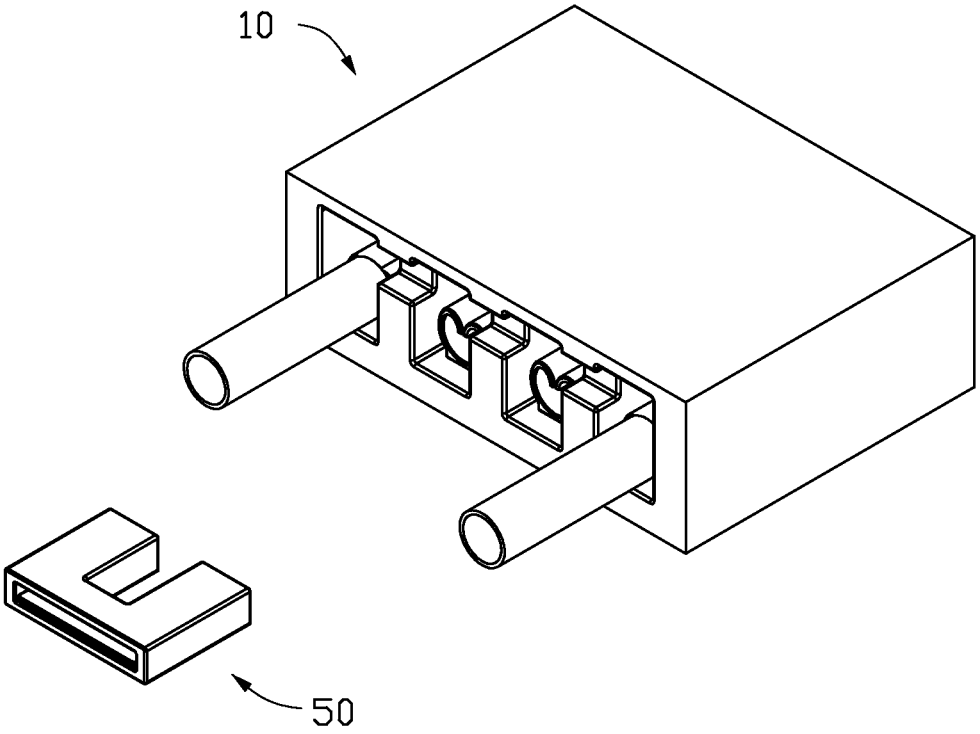
FIG. 1 is an exploded, isometric view of a connecting device in accordance with an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 illustrates an embodiment of a connecting device including a connector 10 and a jumper 50.

Figure 2:
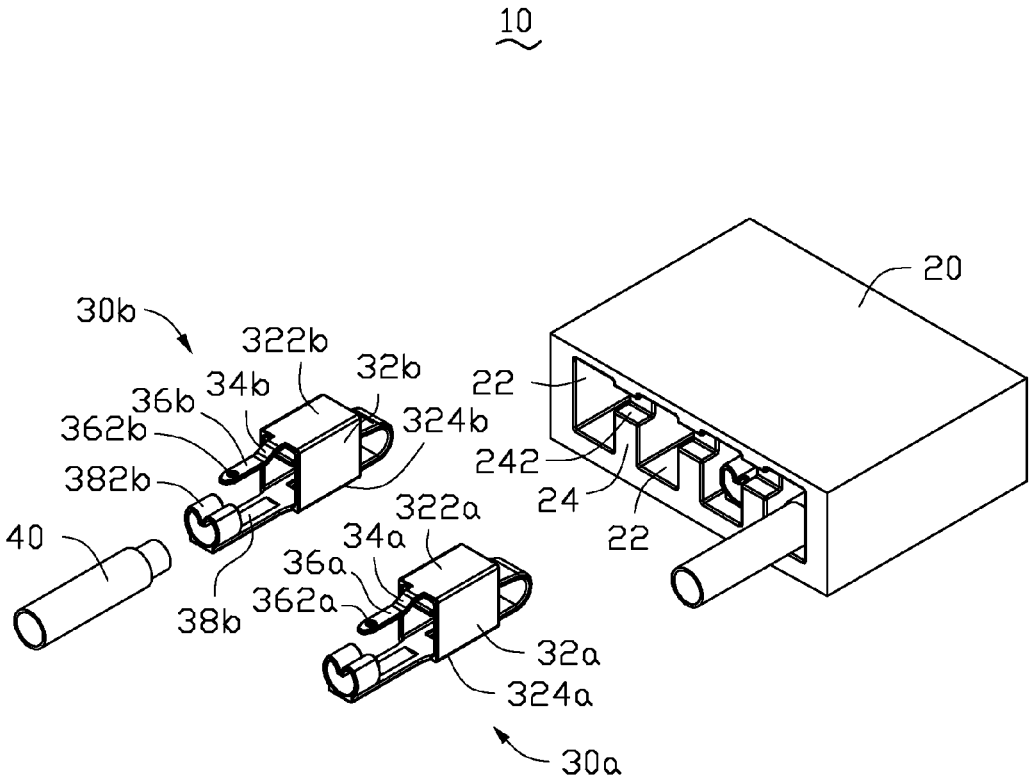
FIG. 2 is an exploded, isometric view of a connector of the connecting device of FIG. 1.

FIG. 2 illustrates the connector 10 can include an enclosure 20, a first terminal 30*a*, a second terminal 30*b*, and a power line 40.

The enclosure 20 defines a plurality of securing holes 22. The plurality of securing holes 22 is configured to receive the first terminal 30*a* and the second terminal 30*b*.

The enclosure 20 further includes a plurality of parallel partitions 24. Each partition 24 is located between the two adjacent securing holes 22 and defines a limiting slot 242. The two adjacent securing holes 22 communicate with each other via the limiting slot 242.

The first terminal 30*a* can include a hollow main body 32*a*. The main body 32*a* can include a top wall 322*a* and a bottom wall 324*a* substantially parallel to the top wall 322*a*. The first terminal 30*a* further includes a flange 34*a* and a contact 36*a*. The flange 34*a* extends slantingly from the top wall 322*a* to the bottom wall 324*a*. The contact 36*a* is connected to the top wall 322*a* by the flange 34*a* and substantially parallel to the top wall 322*a*. A distance between the plane of the contact 36*a* and the plane of the bottom wall 324*a* is less than a distance between the plane of the top wall 322*a* and the plane of the bottom wall 324*a*. A free end of the contact 36*a* defines a latching hole 362*a*. In at least one embodiment, the latching hole 362*a* is a through hole.

The second terminal 30*b* can include a hollow main body 32*b*. The main body 32*b* can include a top wall 322*b* and a bottom wall 324*b* parallel to the top wall 322*b*. The second terminal 30*b* further includes a flange 34*b*, a contact 36*b*, and a mounting piece 38*b* extending from the bottom wall 324*b*. The flange 34*b* extends slantingly from the top wall 322*b* to the bottom wall 324*b*. The contact 36*b* is connected to the top wall 322*b* with the flange 34*b* and substantially parallel to the top wall 322*b*. A distance between the contact 36*b* and the bottom wall 324*b* is less than a distance between the top wall 322*b* and the bottom wall 324*b*. A free end of the contact 36*a* defines a latching hole 362*b*. In at least one embodiment, the latching hole 362*b* is a through hole. The mounting piece 38*b* can include a fastening portion 382*b* configured to secure the power line 40. In at least one embodiment, the fastening portion 382*b* is located at a free end of the mounting piece 38*b* and substantially torus.

Figure 3:
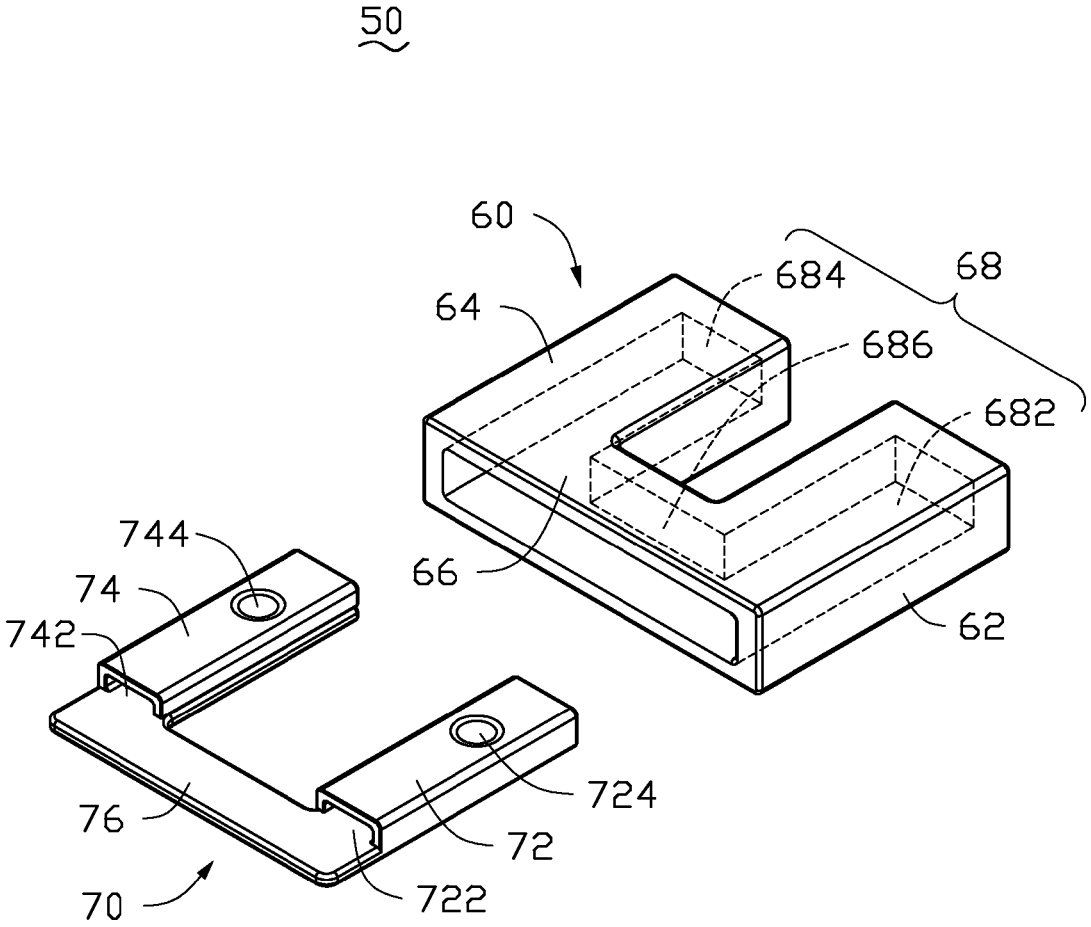
FIG. 3 is an exploded, isometric view of a jumper of the connecting device of FIG. 1.

FIG. 3 illustrates the jumper 50 includes a case 60 and a conductor 70. The case 60 can include a first inserting arm 62, a second inserting arm 64, and a connecting bar 66 connected to the first inserting arm 62 and the second inserting arm 64. The first inserting arm 62 and the second inserting arm 64 extend substantially perpendicularly from two opposite sides of the connecting bar 66 and are substantially parallel to each other.

The case 60 defines a receiving space 68 configured to receive the conductor 70. The receiving space 68 can extend through two ends of the case 60. The receiving space 68 can include a first receiving slot 682 defined in the first inserting arm 62, a second receiving slot 684 defined in the second inserting arm 64, and a connecting slot 686 defined in the connecting bar 66. The first receiving slot 682, the second receiving slot 684, and the connecting slot 686 communicate with each other. A substantially U-shaped configuration is defined by the first receiving slot 682, the second receiving slot 684, and the connecting slot 686. In at least one embodiment, the case 60 is hollow and substantially U-shaped.

The conductor 70 can include a first contacting arm 72, a second contacting arm 74, and a connecting piece 76 connected to the first contacting arm 72 and the second contacting arm 74. The first contacting arm 72 and the second contacting arm 74 are substantially parallel to each other and substantially perpendicular to the connecting piece 76. A substantially U-shaped configuration is defined by the first contacting arm 72, the second contacting arm 74, and the connecting piece 76. A first receiving groove 722 is defined in the first contacting arm 72 along the lengthwise direction and configured to receive the contact 36*a*. A first latching portion 724 is configured to be engaged in the latching hole 362*a* and protrudes from a top surface of the first contacting arm 72 to the first receiving groove 722. A second receiving groove 742 is defined in the second contacting arm 74 along the lengthwise direction and configured to receive the contact 36*b*. A second latching portion 744 protrudes from a top surface of the second contacting arm 74 to the second receiving groove 742 and is configured to be engaged in the latching hole 362*b*. In at least one embodiment, the first contacting arm 72 is the same as the second contacting arm 74, a thickness of the connecting piece 76 is less than that of the first contacting arm 72 and the second contacting arm 74.

Figure 4:
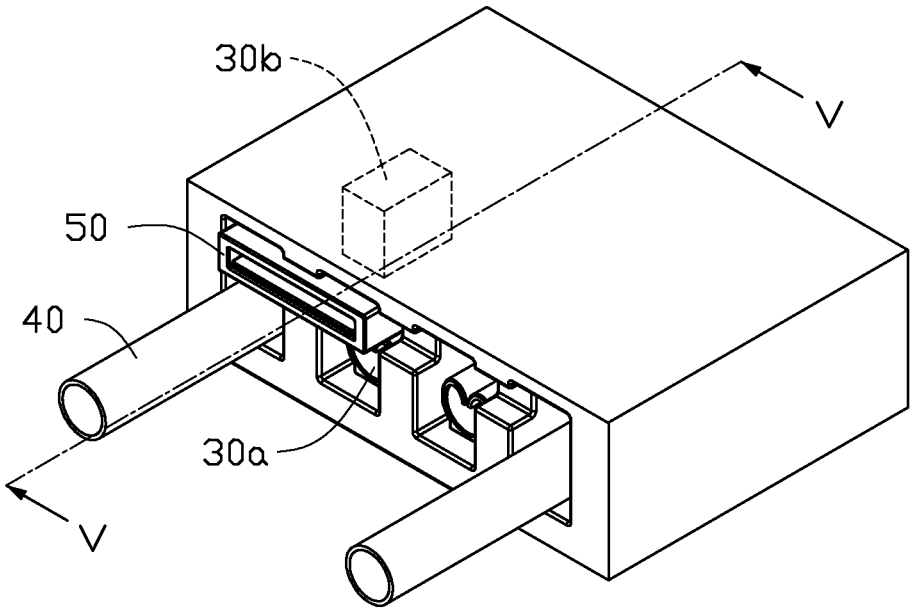
FIG. 4 is an assembled, isometric view of the connecting device of FIG. 1.
Figure 5:
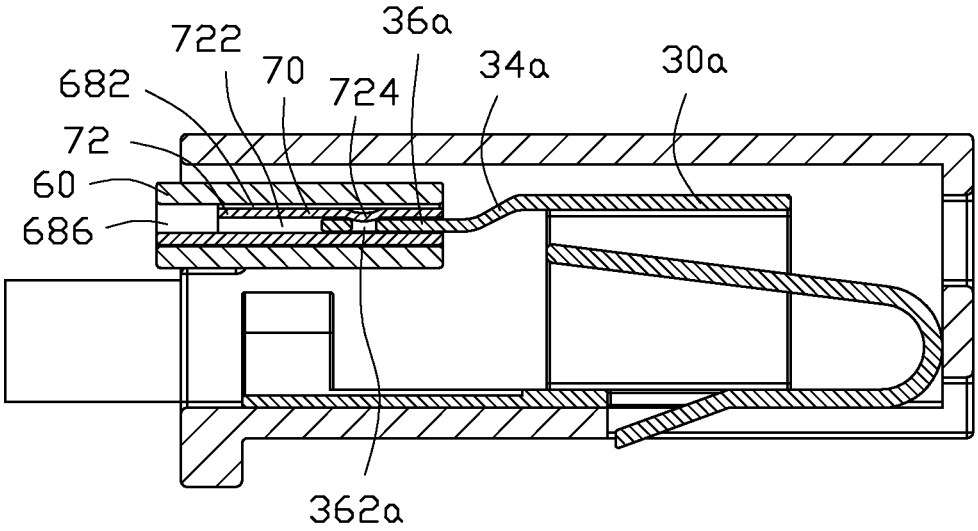
FIG. 5 is a cross-sectional view of the connecting device of FIG. 4, taken along a line V-V.

FIGS. 4 and 5 illustrate the connecting device of an embodiment in assembly. The first terminal 30*a* and the second terminal 30*b* are received in the two adjacent receiving holes 22. The power line 40 is secured in the fastening portion 382*b* of the second terminal 30*b*. The conductor 70 is received in the receiving space 68. The first contacting arm 72 is received in the first receiving slot 682, the second contacting arm 74 is received in the second receiving slot 684, and the connecting piece 76 is received in the connecting slot 686. A thickness of the connecting piece 76 is less than a height of the connecting slot 686, so that a gap is defined between the connecting piece 76 and a top surface of the connecting slot 686. The conductor 70 can be conveniently inserted into the receiving space 68 or detached from the receiving space 68 via the gap.

The jumper 50 can be assembled with the connector 10 when users need to perform a special function. The first inserting arm 62 is inserted into one receiving hole 22 to engage the first terminal 30*a* with the first contacting arm 72, the second inserting arm 64 is inserted into one receiving hole 22 to engage the second terminal 30*b* with the second contacting arm 74, and the connecting bar 66 is engaged in the limiting slot 242. The flange 36*a* is inserted into the first receiving groove 722 to engage the first latching portion 724 in the latching hole 362*a*, the flange 36*b* is inserted into the second receiving groove 742 to engage the second latching portion 744 in the latching hole 362*b*, for allowing the jumper 50 to mate to the connector 10. The first terminal 30*a* is electronically coupled to the second terminal 30*b* by the conductor 70 of the jumper 50. In at least one embodiment, the connector 10 can be assembled with a plurality of jumpers 50 according to requirement.

The embodiments shown and described above are only examples. Many details are often found in the art such as the other features of a connecting device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A connecting device comprising:

a connector having:

an enclosure; and two terminals mounted in the enclosure and spaced apart, each terminal having a contact including a defined latching hole; and a jumper having:

a case; and a conductor received in the case, the conductor having two contacting arms with a latching portion each;

wherein the jumper is engageable with the connector such that each contact extends into the case, each latching portion is engaged in one of the two latching holes, and the two terminals are electronically coupled to each other;

wherein the enclosure defines two securing holes, the case comprises two inserting arms each received in one of the two securing holes; the case defines a receiving space comprising two receiving slots for receiving the two contacting arms, and each of the two receiving slots extends through two ends of one of the two inserting arms.

2. The connecting device of claim 1, wherein each terminal and each inserting arm are corporately received in one of the two securing holes.

3. The connecting device of claim 1, wherein each contacting arm defines a receiving groove, and each contact is received in one of the two receiving grooves.

4. The connecting device of claim 3, wherein the latching portion protrudes from a sidewall of the contacting arm to the receiving groove.

5. The connecting device of claim 1, wherein the case further comprises a connecting bar connected to the two inserting arms, the enclosure further comprises a partition located between the two securing holes, and the connecting bar is engaged in a limiting slot defined in the partition.

6. The connecting device of claim 5, wherein the conductor further comprises a connecting piece connected to the two contacting arms, a U-shaped configuration is defined by the connecting piece and the two contacting arms.

7. The connecting device of claim 6, wherein the receiving space further comprises a connecting slot connected to the two receiving slots; each receiving slot is defined in one of the two inserting arms, and the connecting slot is defined in the connecting bar; each contacting arm is received in one of the two receiving slots, and the connecting piece is received in the connecting slot.

8. The connecting device of claim 7, wherein a thickness of the connecting piece is less than a height of the connecting slot.

9. The connecting device of claim 1, wherein each terminal comprises a main body and a flange, the main body comprises a top wall and a bottom wall, the contact is connected to the top wall with the flange, and a distance between the plane of the contact and the plane of the bottom wall is less than a distance between the plane of the top wall and the plane of the bottom wall.

10. The connecting device of claim 9, wherein the contact is substantially parallel to the top wall.

11. The connecting device of claim 10, wherein the flange extends slantingly from the top wall to the bottom wall.

12. The connecting device of claim 10, wherein one of the two terminals comprises a mounting piece extending from the bottom wall, the mounting piece comprises a fastening portion configured to mount a power line.

13. A connecting device comprising:

a connector comprising:

an enclosure defining two securing holes; and two terminals received in the securing holes respectively, each terminal comprising a contact; and a U-shaped jumper mounted to the connector and comprising:

a case comprising a first inserting arm located in one securing hole and a second inserting arm located in another securing hole; and a conductor received in the case;

wherein the two contacts extend into the case and are contacted with the conductor, for allowing one of the two terminals to electronically connect another of the two terminals;

wherein each terminal comprises a main body and a flange, the main body comprises a top wall and a bottom wall, the contact is connected to the top wall with the flange, and a distance between the plane of the contact and the plane of the bottom wall is less than a distance between the plane of the top wall and the plane of the bottom wall.

14. The connecting device of claim 13, wherein one of the two terminals comprises a mounting piece extending from the bottom wall, the mounting piece comprises a fastening portion configured to mount a power line.

15. The connecting device of claim 13, wherein the case further comprises a connecting bar connected to the first inserting am and the second inserting arm, the enclosure further comprises a partition located between the two securing holes, the connecting bar is engaged in the limiting slot defined in the partition.

16. The connecting device of claim 15, wherein the first inserting arm and the second inserting arm are parallel to each other and substantially perpendicular to the connecting bar.

17. The connecting device of claim 13, wherein the first inserting arm defines a first receiving slot, and the second inserting arm defines a second receiving slot; the conductor comprises a first contacting arm received in the first receiving slot and a second contacting arm received in the second receiving slot; one contact is received in a first receiving groove defined in the first contacting arm, and another contact is received in a second receiving groove defined in the second contacting arm.

18. The connecting device of claim 17, wherein each contact defines a latching hole, the first contacting arm comprises a first latching portion engaged in one latching hole, and the second contacting arm comprises a second latching portion engaged in another latching hole.

19. A connecting device comprising:

a connector having:

an enclosure; and two terminals mounted in the enclosure and spaced apart, each terminal having a contact including a defined latching hole; and a jumper having:

a case; and a conductor received in the case, the conductor having two contacting arms with a latching portion each;

wherein the jumper is engageable with the connector such that each contact extends into the case, each latching portion is engaged in one of the two latching holes, and the two terminals are electronically coupled to each other;

wherein each terminal comprises a main body and a flange, the main body comprises a top wall and a bottom wall, the contact is connected to the top wall with the flange, and a distance between the plane of the contact and the plane of the bottom wall is less than a distance between the plane of the top wall and the plane of the bottom wall.

* * * * *